US006209284B1

(12) United States Patent
Porter

(10) Patent No.: US 6,209,284 B1
(45) Date of Patent: Apr. 3, 2001

(54) ASYMMETRIC STRUCTURAL INSULATED PANELS FOR USE IN 2X STICK CONSTRUCTION

(76) Inventor: William H. Porter, P.O. Box 249, Saugatuck, MI (US) 49453

( * ) Notice: Subject to any disclaimer, the term of this patent is extended or adjusted under 35 U.S.C. 154(b) by 0 days.

(21) Appl. No.: 09/260,847

(22) Filed: Mar. 1, 1999

(51) Int. Cl.[7] ..... E04B 2/34

(52) U.S. Cl. ..... 52/794.1; 52/268; 52/270; 52/407.3; 52/586.1; 52/309.11

(58) Field of Search ..... 52/309.2, 309.9, 52/309.7, 309.5, 586.1, 794.1, 801.1, 802.11, 483.1, 404.1, 309.11, 268, 270, 407.3, 781.3, 261, 262, 404.2, 796.1

(56) References Cited

U.S. PATENT DOCUMENTS

| | | | | |
|---|---|---|---|---|
| 4,051,641 | * | 10/1977 | Elliott | 52/483.1 |
| 4,147,004 | * | 4/1979 | Day et al. | 52/309.9 |
| 4,443,988 | * | 4/1984 | Coutu, Sr. | 52/309.9 |
| 4,575,981 | * | 3/1986 | Porter | 52/309.9 |
| 4,671,038 | * | 6/1987 | Porter | 52/586.1 |
| 4,726,973 | * | 2/1988 | Thompson | 428/45 |
| 4,765,105 | * | 8/1988 | Tissington et al. | 52/309.11 |
| 4,786,547 | * | 11/1988 | St-Michel | 428/215 |
| 4,936,078 | * | 6/1990 | Porter | 52/592.1 |
| 5,345,738 | * | 9/1994 | Dimakis | 52/309.9 |
| 5,497,589 | * | 3/1996 | Porter | 52/309.7 |
| 5,628,158 | * | 5/1997 | Porter | 52/309.9 |
| 5,950,389 | * | 9/1999 | Porter | 52/586.1 |
| 5,953,883 | * | 9/1999 | Ojala | 52/794.1 |

* cited by examiner

*Primary Examiner*—Christopher T. Kent
*Assistant Examiner*—Jennifer I. Thissell
(74) *Attorney, Agent, or Firm*—Emrich & Dithmar

(57) ABSTRACT

An asymmetric structural insulated panel for building construction includes a generally planar insulating core such as of plastic foam or wheat-, straw-, or agricultural board. Adhered to a first surface of the insulating core is an outer facing of a conventional building material such as wood, oriented strand board (OSB), gypsum composite or cement. Adhered to a second opposed surface of the insulating core by means of a conventional adhesive is a thin, high strength sheet of paper impregnated with plastic such as polyisocyanurate. The plastic impregnated paper provides a high tensile strength for the structural insulated panel to accommodate large transverse loads on the panel. The panels may be incorporated in conventional stick construction employing 2× dimensional structural lumber members by attaching the panel's outer facing to one side of a 2× structural member after notching out an edge of the panel's insulating core. The panels have the same thickness as 2× structural members allowing the panels to be incorporated in a stick built wall, ceiling or roof without requiring modifications such as window or door jamb extensions. Narrow openings, e.g., less than approximately 4 feet, can be made in the panel in the field using a conventional circular saw.

14 Claims, 9 Drawing Sheets

ASYMMETRIC STRUCTURAL INSULATED PANELS FOR USE IN 2X STICK CONSTRUCTION

FIELD OF THE INVENTION

This invention relates generally to structural insulated panels for use in building construction and is particularly directed to a structural insulated panel having an inner plastic foam core with a rigid outer facing on one surface thereof and plastic impregnated paper on a second opposed surface of the foam core which is particularly adapted for use in 2× stick construction.

BACKGROUND OF THE INVENTION

Lumber stick construction which employs 2× dimensional structural lumber members and nails is how most houses are constructed. This handcrafted stick built approach is slow and manpower intensive requiring many hours of field work, requires a large supply of a limited natural resource, typically incorporates many thermal bridges in combination with gaps in insulation and thus is not particularly energy efficient, and affords a limited number of structural shapes. An alternative approach employs steel studs. This approach also suffers from limitations in that the steel studs are difficult to work with and are good thermal conductors of heat through walls and roofs.

Another approach gaining increasing acceptance involves the use of Structural Insulated Panels (SIPs). SIP construction typically employs two rigid faces on either side of a light insulating foam core. High strength bonding of the outer facings to the inner core forms a structural I-beam in the form of flat panels which are typically joined together by lumber and nails. The outer, opposed panel faces are generally formed from conventional building materials such as gypsum or cementous composites, plywood, oriented strand board (OSB), drywall, or other rigid construction boards from ¼" to ¾" thick. Several factors have impeded widespread acceptance of SIPs in building construction. For example, the use of SIPs requires a great deal of preplanning for efficient field erection because these panels are not easily field-cut without the use of special tools. Manufacturing the panels involves 4–5 times the amount of time cutting and sizing the panels in the shop than required in laminating the panels. This increased in-shop preparation of the panels also requires additional in-house designers. In addition, these panels are generally heavy, weighing much more than conventional wallboard panels, and frequently require the use of special handling equipment such as cranes. Because SIPs are difficult to modify in the field, more precise planning and building techniques are required than the stick built approach of simply working out of a wood pile of 2× dimensional structural lumber members. Finally, current double-faced structural insulated panels are typically 5" thick when installed with drywall. This is wider than typical stick framing of 4½" thickness and requires special door and window jamb sizes. Current structural insulated panels are thus incompatible with the conventional 2× structural member system of construction in general use today. For these reasons, contractors have not accepted SIPs as a basic structural member in building construction on a widespread scale.

The present invention addresses the aforementioned limitations of the prior art by providing a lightweight, high strength, insulated panel which is easily fabricated, modified and installed in structures built with 2× stick construction.

OBJECTS AND SUMMARY OF THE INVENTION

Accordingly, it is an object of the present invention to provide a lightweight structural insulated panel which is easier to manufacture and adapt for a specific installation in the field than currently available structural insulated panels.

It is another object of the present invention to provide a structural insulated panel capable of withstanding large transverse, axial and racking loads having an outer rigid facing attached to one surface of an inner insulating core sheet and an inner facing of a high strength, structural paper attached to a second opposed surface of the core sheet and which is particularly adapted for use in and is compatible with conventional stick construction using 2× dimensional structural lumber.

Yet another object of the present invention is to provide a high strength planar structural insulated panel which can be incorporated in walls, ceilings, etc., constructed of 2× dimensional lumber without modifying or adding to the lumber structure.

A further object of the present invention is to provide a lightweight, high strength structural insulated panel having an inner insulating core and a single outer rigid facing for use in a wall, ceiling, floor or roof of a building which is easily adapted in the field for and installed in a particular installation.

This invention contemplates a structural panel coupling arrangement for use in 2× stick construction comprising a 2× structural member of lumber and having a given thickness and a given width; a first asymmetric structural insulated panel having an insulating core, a rigid outer facing attached to a first surface of the insulating core, and a high strength sheet of plastic impregnated paper attached to a second opposed surface of the insulating core, wherein the insulating core has a width equal to the width of the 2× structural member and includes a notched out edge portion forming an edge extension of the rigid outer facing having a thickness equal to the thickness of the 2× structural member; and means for attaching a first surface of the 2× structural member to the edge extension of the rigid outer facing and a third surface of the 2× structural member to the insulating core of the structural insulated panel, wherein the sheet of plastic impregnated paper on the panel is aligned with a third surface of the 2× structural member, and wherein the first and third surfaces are in opposed relation on the 2× structural member.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1A:
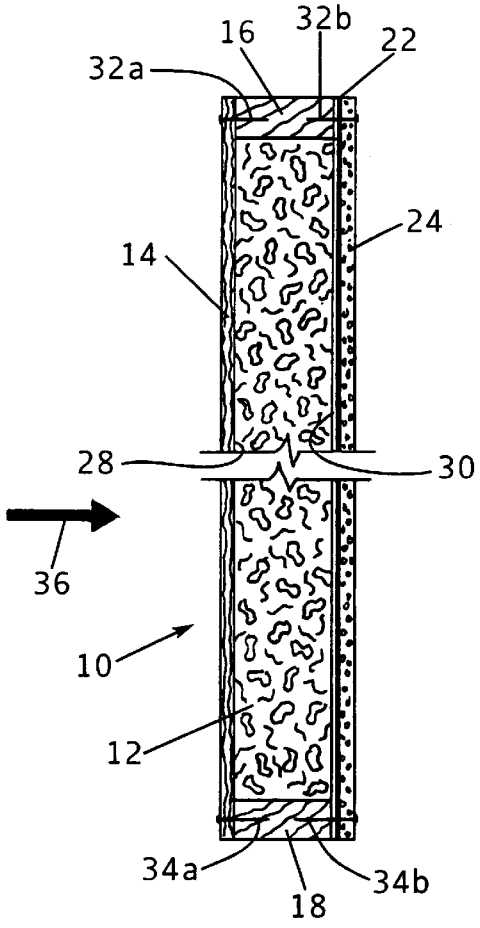
FIG. 1*a* is a partial sectional view of one embodiment of a structural insulated panel.
Figure 1B:
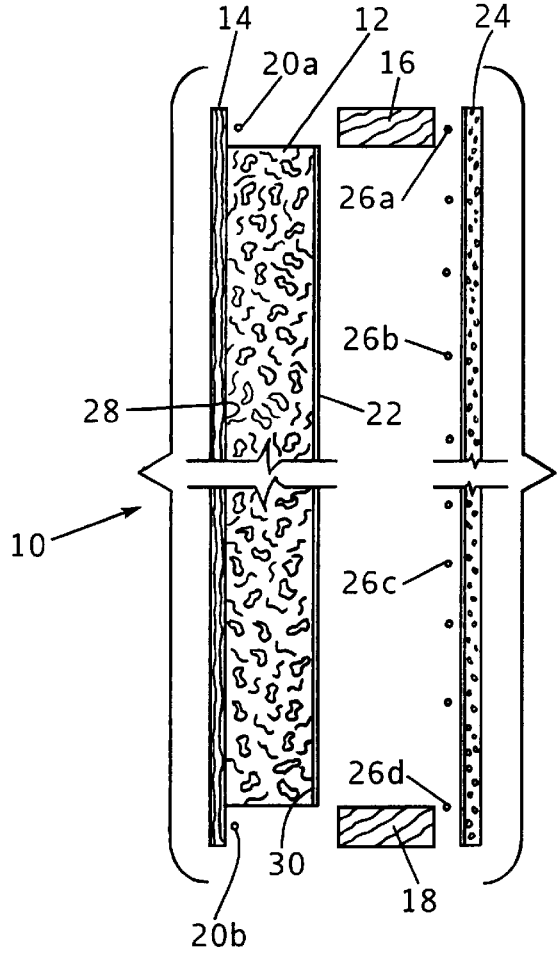
FIG. 1*b* is an exploded sectional view of the structural insulated panel installation of FIG. 1*a;*

Referring to FIG. 1*a,* there is shown a partial sectional view of an asymmetric structural insulated panel 10. FIG. 1*b* is an exploded sectional view of the structural insulated panel installation of FIG. 1*a.* The structural insulated panel 10 includes an inner plastic insulating foam core 12 having a rigid outer facing 14 attached to one surface thereof. Facing 14 may be comprised of a conventional construction material such as metal, oriented strand board (OSB) or plywood and is securely affixed to the surface of the plastic foam core 12 by means of a first adhesive layer 28. Attached to a second opposed surface of the plastic foam core 12 by means of a second adhesive layer 30 is a sheet of plastic impregnated paper 22. The first and second adhesive layers 28, 30 may be comprised of conventional bonding materials such as urethane cement or glue. In a preferred embodiment, the plastic impregnated paper sheet 22 is comprised of paper or box board impregnated with urethane or polysiocyanurate plastic. The plastic impregnated paper sheet 22 in one embodiment is commercially available from Weyerhauser and is sold under the trade name of P-Cell (sometimes referred to as PolyCel). The plastic impregnated paper sheet 22 serves as a vapor barrier near the inside of an exterior wall or roof deck to prevent moisture from entering the inside structure or passing through the panel's plastic foam core to the panel's outer facing 14 and wall cladding, if present. The plastic impregnated paper sheet 22 also provides this surface of the structural insulated panel 10 with a high tensile strength as described below.

Disposed respectively on upper and lower ends of the structural insulated panel 10 are upper and lower plates 16 and 18. Each of the upper and lower plates 16,18 is typically comprised of 2× lumber members. In a typical building installation, the structural insulated panel 10 would be attached to the outer surface of a sheet of composite gypsum drywall 24. Beads of mastic 26*a,* 26*b,* 26*c* and 26*d* are used to securely affix the plastic impregnated paper sheet 22 of structural insulated panel 10 to the outer surface of drywall sheet 24. Affixed to a surface of drywall sheet 24 may be a second plastic impregnated sheet (not shown for simplicity) to further increase the tensile strength of the structural insulated panel and drywall sheet combination. The upper and lower plates 16,18 are used to securely connect the structural insulated panel 10 to the drywall sheet 24 by means of a couplers 32*a,* 32*b* and 34*a,* 34*b.* These couplers are typically nails, but may also be screws. The upper and lower plates 16,18 may also be used to securely attach respective upper and lower edges of the structural insulated panel 10 to upper, or ceiling, and lower, or floor, structural members, although this is not shown in the figures for simplicity. The plastic impregnated paper sheet 22 provides high tensile strength for structural panel 10 when a transverse force is applied to the panel in the direction of arrow 36 shown in FIG. 1*a.* The specified plastic impregnated sheet 22 0.015" in thickness possesses a tensile strength approximately equal to that of 0.4375" OSB (across the grain). This high strength of the plastic impregnated paper sheet 22 in combination with its relatively low cost of $0.07/square foot (OSB cost is approximately $0.29/square foot) makes the use of this paper particularly attractive when used in a structural insulated panel. The structural insulated panel is also much lighter and easier to handle and conform in the field to a specific installation than a double-faced structural insulated panel. Structural panel 10 thus provides a high strength panel having a single outer face which is lighter, and easier to manufacture, modify and install than prior art double faced structural insulated panels.

Figure 2A:
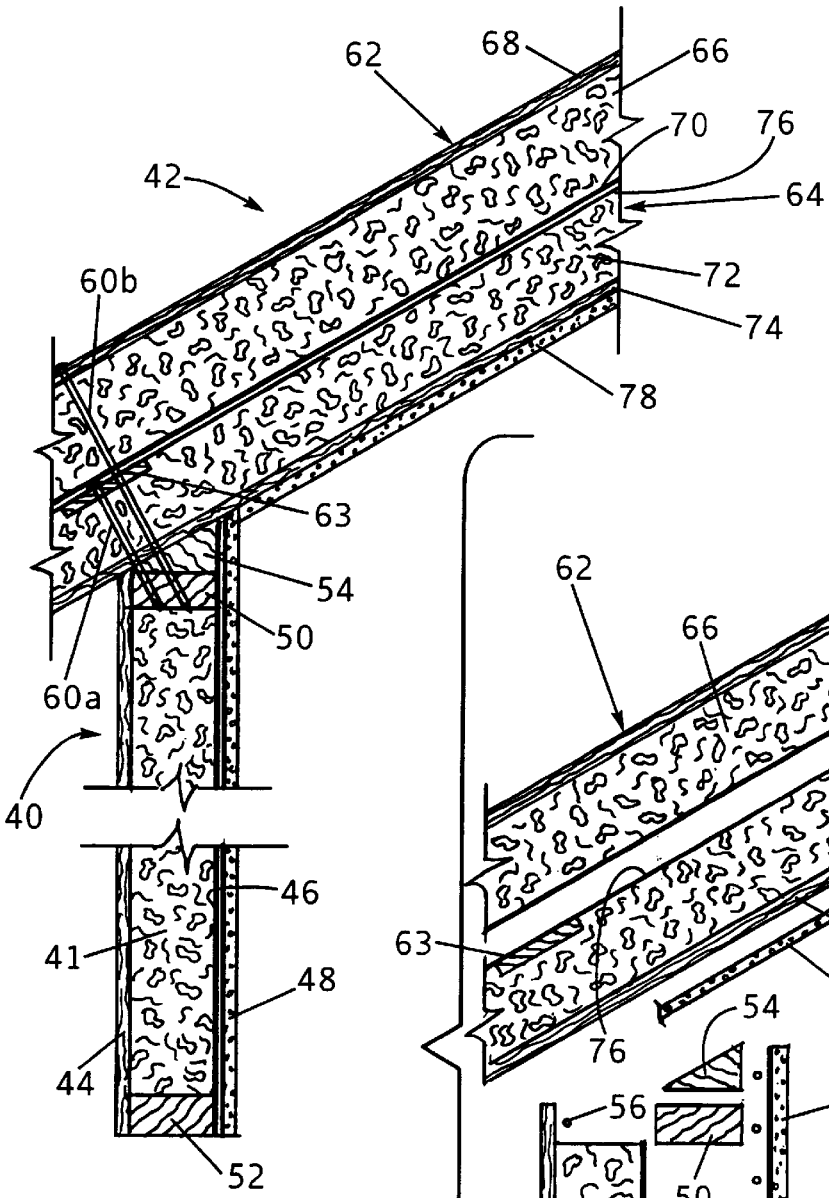
FIG. 2*a* is a sectional view of a wall and roof combination incorporating structural insulated panels.
Figure 2B:
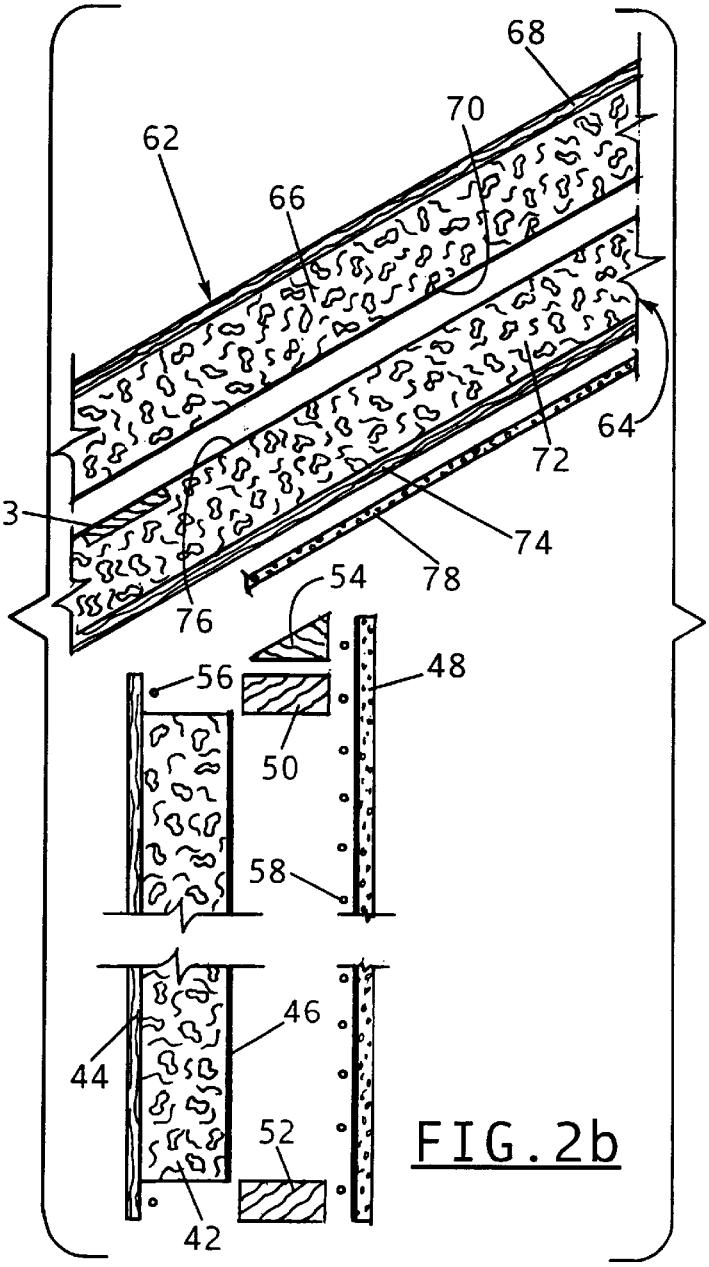
FIG. 2*b* is an exploded sectional view of the wall and roof combination of FIG. 2*a;*

Referring to FIG. 2*a,* there is shown a partial sectional view of a combination wall panel 40 and roof panels 42. FIG. 2*b* is an exploded sectional view of the connected wall and roof panels 40,42 shown in FIG. 2*a.* Wall panel 40 is similar in construction to the wall panel shown in FIGS. 1*a* and 1*b* and includes an inner plastic foam insulating core 41, a rigid outer facing 44 on a first surface of the foam core, and a plastic impregnated paper sheet 46 on a second, opposed outer surface of the foam core. The structural insulated wall panel 40 is attached to a sheet of drywall 48 by means of upper and lower plates 50 and 52 as well as by a plurality of nails or screws as shown in FIG. 2*a.* Upper plate 50 in combination with a triangular spacer plate 54 is also used to securely connect an upper end of the structural insulated wall panel 40 with the roof panels 42 as described below. The upper and lower plates 50, 52 as well as spacer plate 54 are preferably comprised of wood.

Roof panels 42 include a first upper roof panel 62 and a second lower roof panel 64. The first roof panel 62 includes an inner foam core 66, a rigid outer facing 68 disposed on a first surface of the foam core, and a plastic impregnated paper sheet 70 attached to the second, opposed surface of the foam core. As described above, the rigid outer facing 68 and plastic impregnated sheet 46 are affixed to opposed surfaces of the panel's insulating foam core 66 by conventional means such as urethane cement or glue. The plastic insulating foam core 66 is preferably comprised of expanded polystyrene or urethane. The second inner roof panel 64 is similarly comprised of an inner plastic insulating foam core 72, a rigid outer facing 74 attached to a first surface of the panel's foam core, and a plastic impregnated paper sheet 76 attached to a second opposed surface of the panel's inner foam core. The roof panels 42 are positioned on a sheet of wall board 78 and are attached to the upper end of the structural insulated wall panel 40 by means of first and second coupling screws 60*a* and 60*b*. Screw 60*b* is inserted through the rigid outer facings 68 and 74 of the first and second roof panels 62, 64, while screw 60*a* is inserted through rigid outer facing 74. The ends of the first and second screws 60*a*, 60*b* are further inserted into the triangular spacer plate 54 and the wall's upper plate 50 as shown in FIG. 2*a*. Disposed within the second roof panel 64 between the panel's plastic insulated paper sheet 76 and inner foam core 72 is a nailer strip 63. The first and second screws 60*a*, 60*b* are further inserted through nailer strip 63, with the first screw 60*a* engaging the nailer strip for securely attaching the second roof panel 64 to the upper edge of the structural insulated wall panel 40. Nailer strip 63 may be comprised of a conventional building material such as wood or OSB and is bonded to the panel's foam core 72 by a conventional adhesive such as mastic. The adjacent plastic impregnated paper sheets 70 and 75 provide the pair of roof panels 42 with a high tensile strength with respect to both upwardly and downwardly directed forces applied to the roof panels.

Figures 3A, 3B:
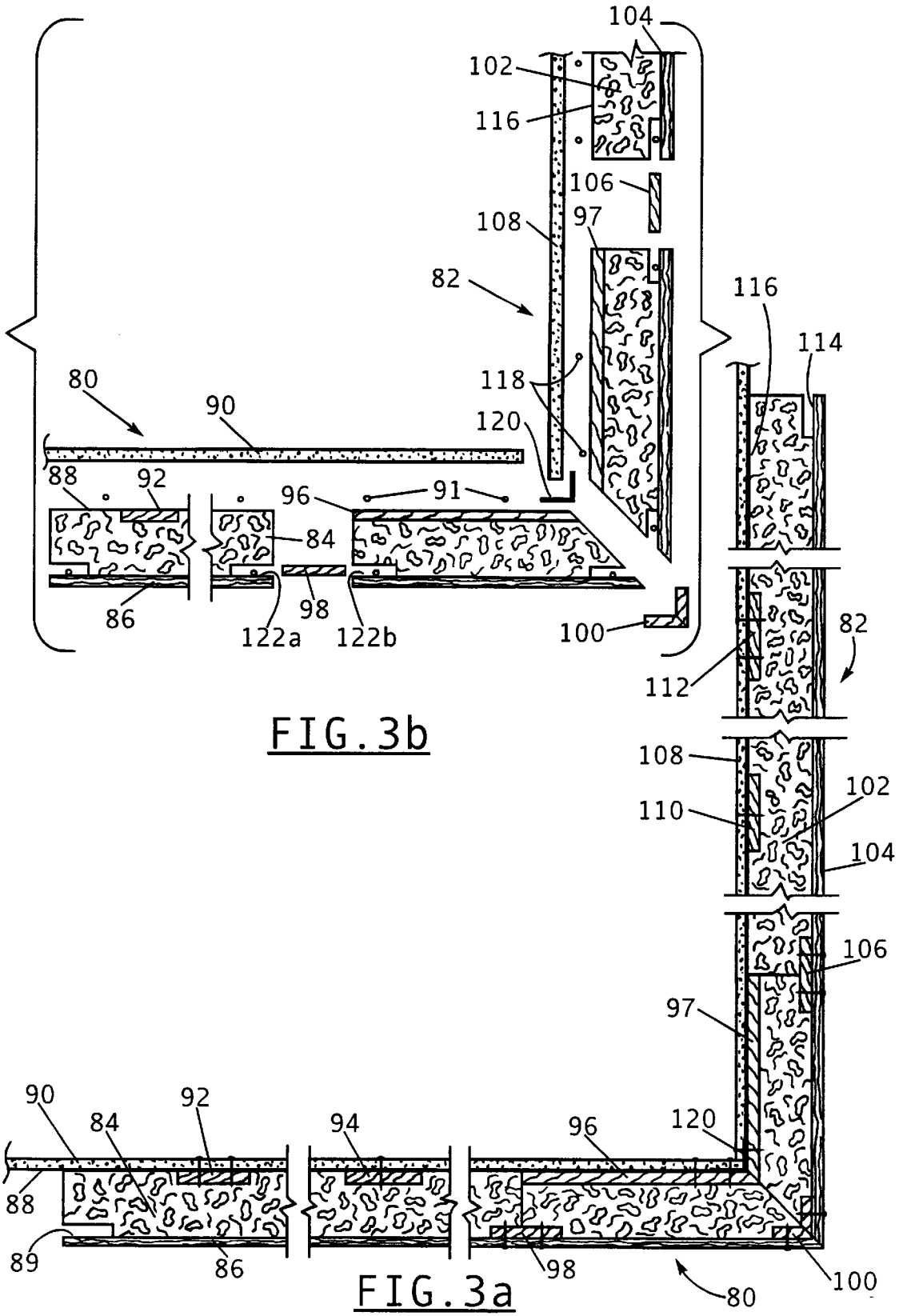
FIG. 3*a* is a partial sectional view of a pair of connected wall sections incorporating structural insulated panels.
FIG. 3*b* is a partial exploded sectional view of the structural insulated panel wall arrangement of FIG. 3*a;*

Referring to FIG. 3*a*, there is shown a partial sectional view of a pair of connected wall sections each incorporating structural insulated panels. FIG. 3*b* is a partial exploded sectional view of the structural insulated panel wall arrangement of FIG. 3*a*. The first wall section includes a first wall panel 80 having an inner insulating foam core 84, a rigid outer facing 86 attached a first surface of the foam core, and a plastic impregnated paper sheet 88 attached to a second opposed surface of the panel's foam core. The first wall panel 80 is shown as including two sections each having a respective edge slot 122*a* and 122*b*. Edge slots 122*a*, 122*b* are each adapted to receive a coupling spline 98 for securely connecting the two wall sections. Beads of mastic are shown deposited in the first and second slots 122*a*, 122*b* for bonding the coupling spline 98 to adjacent sections of the panel's outer facing 86 and foam core 84 in connecting the two wall sections. Also disposed within the first wall panel 80 are first and second nailer strips 92 and 94 and a first inner corner nailer 96. The first and second nailer strips 92, 94 allow the first wall panel 80 to be securely attached to an inner gypsum drywall sheet 90 by conventional couplers such as nails or screws as shown in FIG. 3*a*. Beads of mastic 91 are also used to securely attach the first wall panel's plastic impregnated paper sheet 88 to the gypsum drywall sheet 90. The nailer strips as well as the coupling spline 98 may be comprised of conventional building materials such as wood or OSB.

A second wall panel 82 is similarly comprised of an inner foam core 102, a rigid outer facing 104 attached to one surface of the foam core, and a plastic impregnated paper sheet 116 attached to a second opposed surface of the foam core. The second wall panel 82 is also comprised of a pair of wall sections connected by means of a coupling spline 106 inserted in facing slots in the two wall panel sections. The second wall panel 82 is attached to a drywall sheet 108 by means of beads of mastic 118 as well as by means of nails or screws used with nailers as in the case of the first wall panel 80, where a second inner corner nailer 97 is shown in the figures.

Each of the first and second wall panels 80,82 includes a beveled edge where the two panels are joined to form a 90° angle. A 90° outer corner nailer 100 comprised of OSB laminated to a sheet metal spline is inserted in opposed slots in the bevelled edges of the first and second wall panels 80, 82. The outer comer nailer 100 is securely maintained in the aligned facing slots in the adjoining edges of the first and second wall panels 80,82 by means of mastic beads disposed within the slots. An inner sheet metal corner reinforcing angle 120 is placed in contact with the inner surfaces of the first and second inner corner nailers 96,97 of the first and second wall panels 80,82. Nails or screws are inserted through the drywall sheets 90 and 108, as well as through the sheet metal corner reinforcing angle 120 and the first and second inner corner nailers 96,97 for securely connecting the inner edges of the first and second wall panels 80, 82. Similarly, nails or screws are inserted through the rigid outer facings 86 and 104 of the first and second wall panels 80,82 as well as through the outer corner nailer 100 for securely connecting the outer edges of the two wall panels. The plastic impregnated paper sheets 88 and 116 provide the first and second wall panels 80,82 with substantial tensile strength to withstand a large transverse force applied to the outer facings of these panels. The various nailer strips and the inner corner nailers 96,97 facilitate attaching the first and second wall panels 80,82 to drywall sheets 90 and 108 using either nails or screws. The nailer strips also provide the inner surface portions of the two wall panels with the capacity to withstand a large transverse force as well as the ability to accommodate large axial (along the length of the panel) and racking (along the width of the panel) loads. Bonding between the wall panels and the drywall sheets is further enhanced by mastic beads disposed between these structural members. In this as well as in the other embodiments described herein, the plastic impregnated paper sheet may be affixed to a sheet of drywall to which the structural insulated panel is attached rather than to the panel's insulating foam core to provide the panel with the increased strength described above. The rigid outer facings as well as the various nailers in the embodiment shown in FIGS. 3*a* and 3*b*, as well as in the various other embodiments described herein, may be comprised of common building materials such as metal, wood, oriented strand board, composite gypsum or cement.

Figure 4:
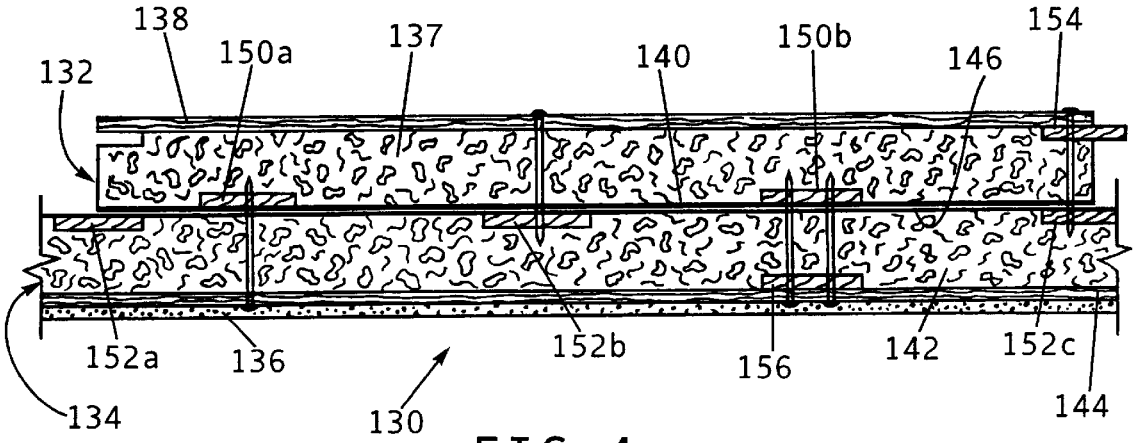
FIG. 4 is a sectional view showing additional details of a structural member such as a wall, roof, ceiling, or floor incorporating a pair of connected structural insulated panels.

Referring to FIG. 4, there is shown a sectional view illustrating additional details of a horizontal roof section 130 incorporating an upper roof panel 132 and a lower roof panel 134. Although the structural member shown in FIG. 4 is described as a horizontal roof section, the structural member shown therein may also form a wall, a ceiling, or a floor in a building. As in the previously described embodiments, the upper roof panel 132 includes an inner insulating foam core 137, an outer facing 138 attached to an upper surface of the foam core, and a plastic impregnated paper sheet 140 attached to the opposed, lower surface of the panel's foam core. Similarly, the lower roof panel 134 includes an insulating foam core 142, a rigid outer facing 144 attached to a lower surface of the foam core, and a plastic impregnated paper sheet 146 attached to an opposed, upper surface of the panel's foam core. Disposed within the upper roof panel 132 in a spaced manner are nailers 150*a* and 150*b*. Disposed within the lower roof panel 134 in a spaced manner are a second plurality of nailers 152*a*, 152*b* and 152*c*. Each of the nailers is disposed within the insulating foam core of its associated panel adjacent the panel's plastic impregnated paper sheet and is adapted to receive either a nail or a screw inserted through the outer facing of the other panel for securely joining the upper and lower roof panels 132,134. Each of the upper and lower roof panels 132,134 is comprised of at least a pair of joined roof sections each having slots in their opposed surfaces for receiving a coupling spline. Thus, coupling spline 156 is inserted in adjacent sections of the lower roof panel 134 for securely connecting the two lower roof sections, while coupling spline 154 connects adjacent sections of the upper roof panel 132. As shown in FIG. 4, nails or screws are inserted through each of the coupling splines in one of the roof panels as well as through a nailer in the other roof panel for securely connecting the upper and lower roof panels. A drywall sheet 136 is shown attached to the lower surface of the lower roof panel 134 by conventional means such as beads of mastic which are not shown for simplicity.

Figure 5A:
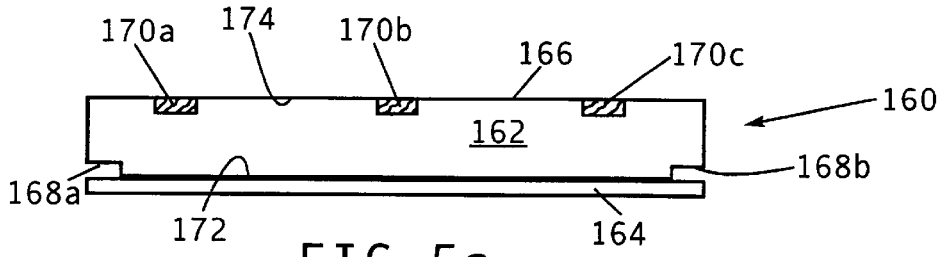
FIGS. 5*a,* 5*b* and 5*c* are respectively front, top planar and side elevations views shown partially in phantom of another embodiment of a structural insulated panel.
Figure 5B:
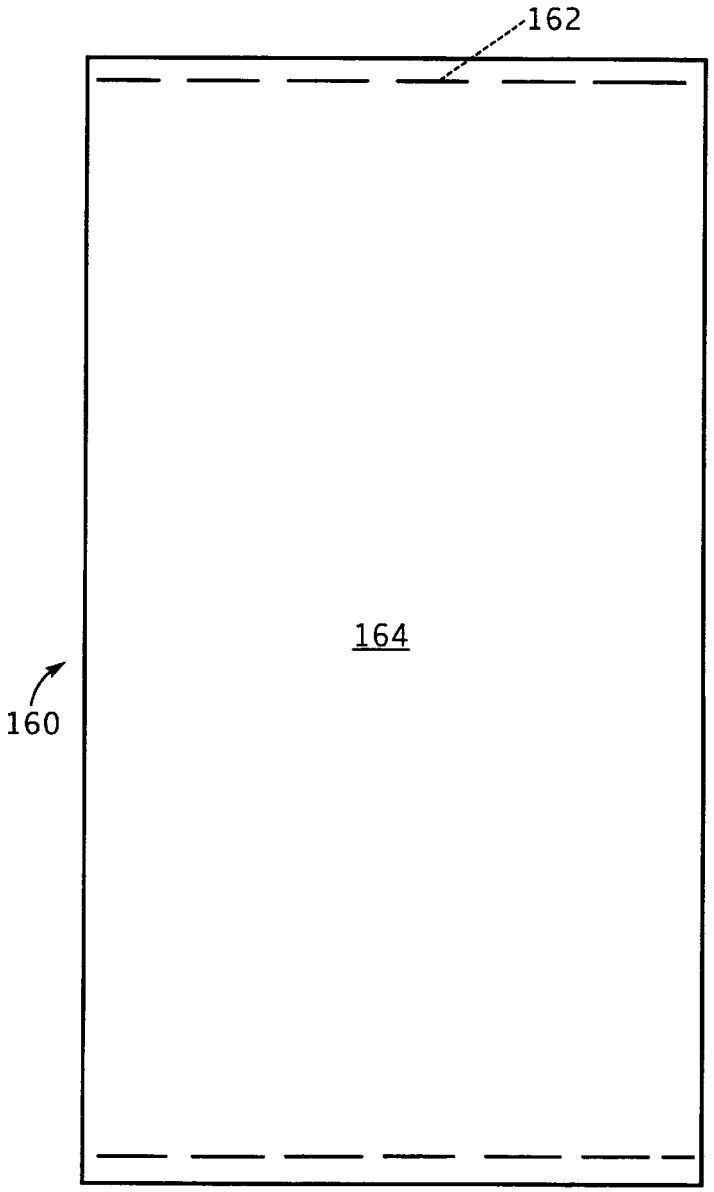
Figure 5C:
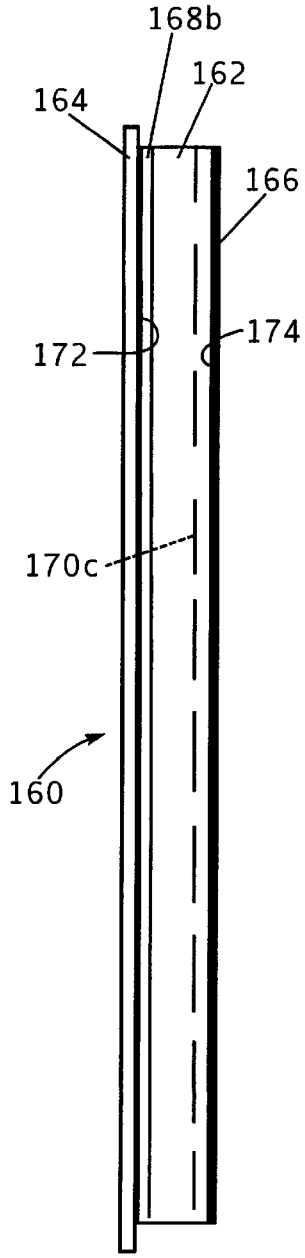

Referring to FIGS. 5*a,* 5*b,* and 5*c,* there are respectively shown top plan, front elevation and side elevation views shown partially in phantom of a structural insulated panel 160. Structural insulated panel 160 includes an inner insulating foam core 162, a rigid outer facing 164 disposed on one surface of the foam core, and a plastic impregnated paper sheet 166 attached to a second opposed surface of the panel's foam core. As in the previously described embodiments, opposed edges of the structural insulated panel 160 are provided with coupling slots 168*a* and 168*b* each running the length of the panel which are adapted to receive respective coupling splines (not shown for simplicity) as described above. First and second adhesive layers 172 and 174 respectively couple the rigid outer facing 164 and the plastic impregnated paper sheet 166 to opposed surfaces of the panel's insulating foam core 162. Disposed within the foam core 162 in a spaced manner are first, second and third internal nailers 170*a,* 170*b* and 170*c*. Beads of mastic may be used to securely attach each of the internal nailers 170*a,* 170*b* and 170*c* to the panel's insulating foam core 162. Each of the internal nailers 170*a,* 170*b* and 170*c* facilitates attaching the structural insulated panel 160 to a support structure such as a sheet of drywall and increases the compressive strength of the panel as previously described. Nails or screws inserted through the aforementioned support structure (which is not shown in the figures for simplicity) and into the internal nailers provide secure coupling between the structural insulated panel 160 and the support structure.

Figure 6A:
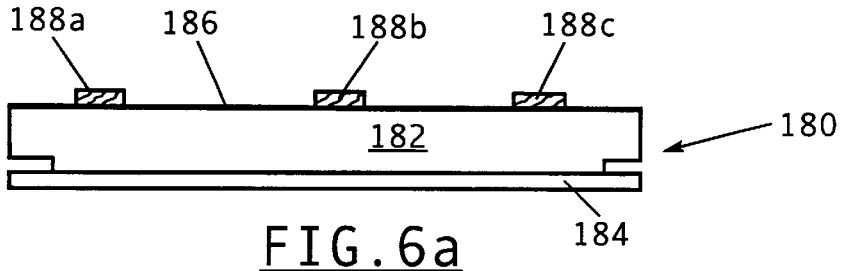
FIGS. 6*a,* 6*b* and 6*c* are respectively front, top plan and side elevation views of a structural insulated panel.
Figure 6B:
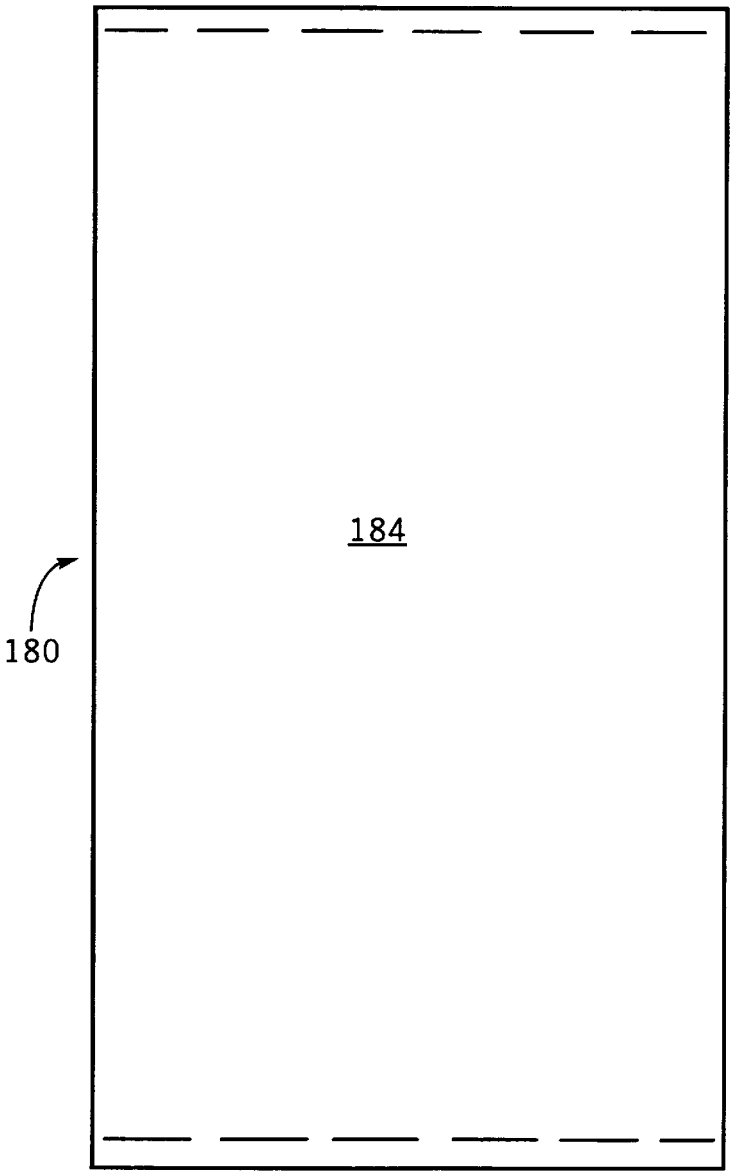
Figure 6C:
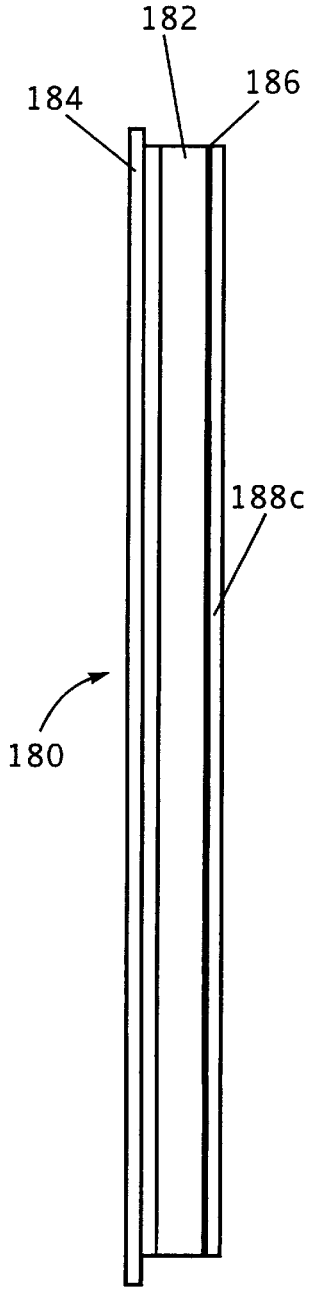

Referring to FIGS. 6*a,* 6*b* and 6*c,* there are respectively shown top plan, front elevation and side elevation views of a structural insulated panel 180. As in the previously described embodiment, the structural insulated panel 180 includes an inner foam core 182, a rigid outer facing 184 attached one surface of the front core, and a plastic impregnated paper sheet 186 attached to a second opposed surface of the panel's foam core. In the embodiment shown in FIGS. 6*a,* 6*b,* and 6*c,* three external nailers 188*a,* 188*b* and 188*c* are attached to the outer surface of the panel's plastic impregnated paper sheet 186 by conventional means such as beads of mastic. As in the previously described embodiments, external nailers 188*a,* 188*b* and 188*c* facilitate attachment of the structural insulated panel 180 to a structural support member such as a sheet of drywall (not shown in the figures for simplicity) and substantially increase the panel's compressive strength.

Figure 7A:
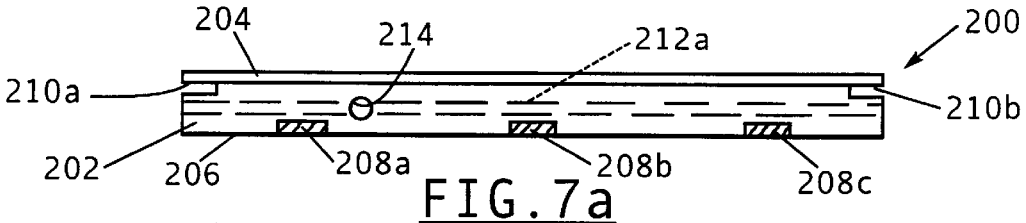
FIGS. 7*a,* 7*b* and 7*c* are respectively top plan, partial side elevation, and partial front views of still another embodiment of a structural insulated panel.
Figure 7B:
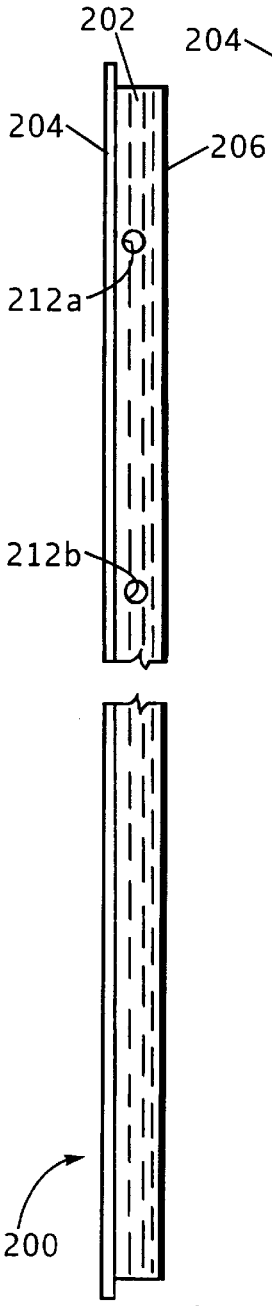
Figure 7C:
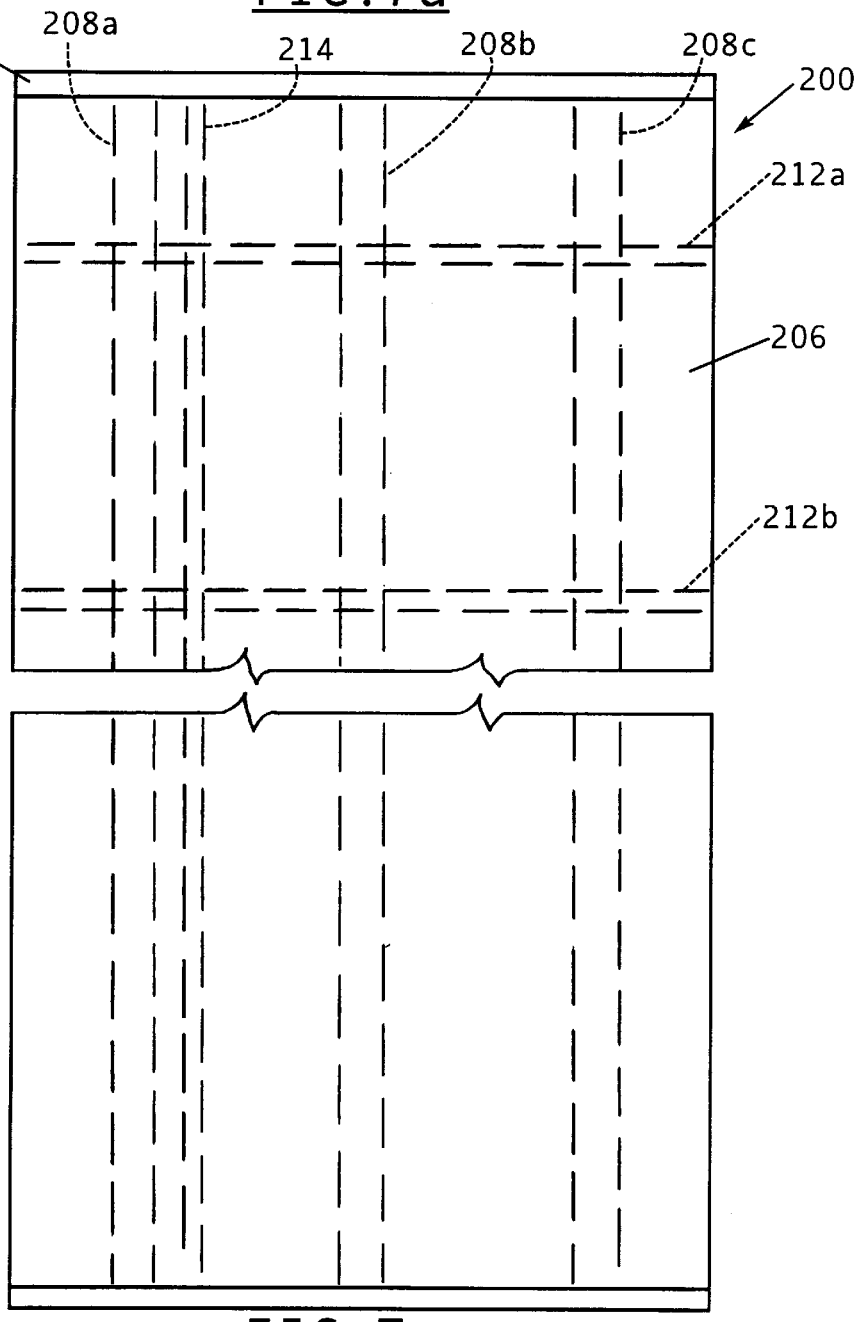

Referring to FIGS. 7*a,* 7*b* and 7*c* there are respectively shown top plan, partial side elevation, and partial front views of a structural insulated panel 200. FIGS. 7*a,* 7*b* and 7*c* are shown partially in phantom to illustrate additional details of this embodiment of the invention. The structural insulated panel 200 includes an inner insulating foam core 202, a rigid outer facing 204 affixed to one surface of the foam core, and a plastic impregnated paper sheet 206 affixed to a second, opposed surface of the panel's foam core. Conventional adhesives are used to bond the rigid outer facing 204 and the plastic impregnated paper sheet 206 to opposed surfaces of the panel's insulating foam core 202. Disposed in a spaced manner within an outer surface of the panel's foam core 202 are first, second and third internal nailers 208*a,* 208*b* and 208*c* in the form of elongated, linear strips of metal, wood or OSB. A conventional bonding agent such as mastic is used to affix each of the first, second and third internal nailers 208*a,* 208*b* and 208*c* to the panel's foam core 202 as well as to the plastic impregnated paper sheet 206. Coupling slots 210*a* and 210*b* in opposed edges of the insulating foam core 202 allow the structural insulated panel 200 to be securely connected to adjacent similar structural insulated panels by means of connecting splines as described above. Disposed within the foam core 202 and extending the width of the structural insulated panel 200 are first and second horizontal electrical chases 212*a* and 212*b*. Also disposed within the foam core 202 and extending the length of the panel 200 is a vertical electrical chase 214 which intersects each of the first and second horizontal electrical chases 212*a* and 212*b*. In a preferred embodiment, the panel's insulating foam core 202 is comprised of expanded polystyrene, urethane or polysiocyanurate foam, while a preferred bonding agent is Morton 640 series adhesive. The panel's external rigid outer facing 204 and each of the internal nailers 208*a,* 208*b* and 208*c* are preferably comprised of OSB.

Figure 8A:
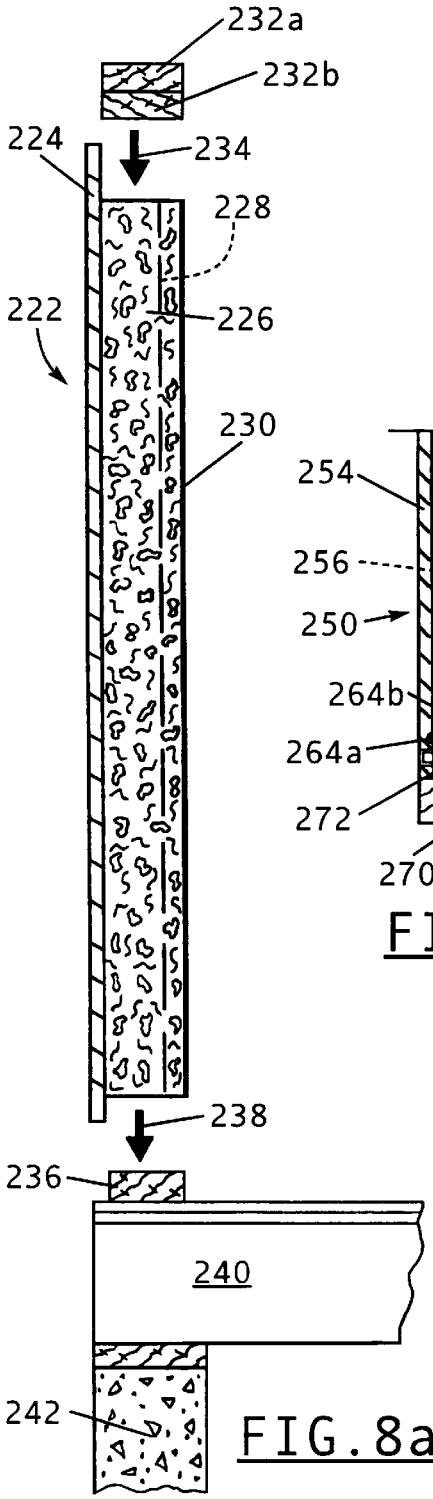
FIGS. 8*a* and 8*b* are respectively exploded and assembled sectional views of an asymmetric structural insulated panel incorporated in a 2× based structure in accordance with the present invention.
Figure 8C:
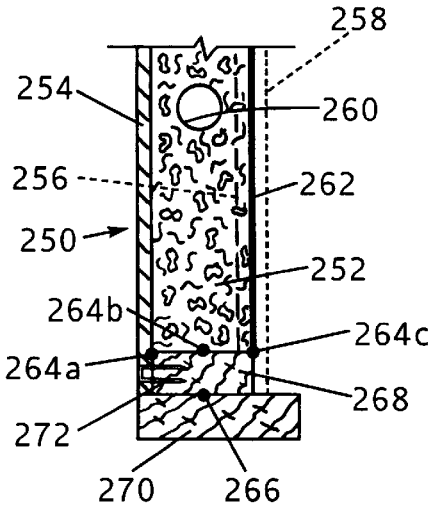
FIG. 8*c* is a sectional view of another arrangement for attaching an asymmetric structural insulated panel to a 2× based support structure in accordance with another aspect of the present invention.
Figure 8B:
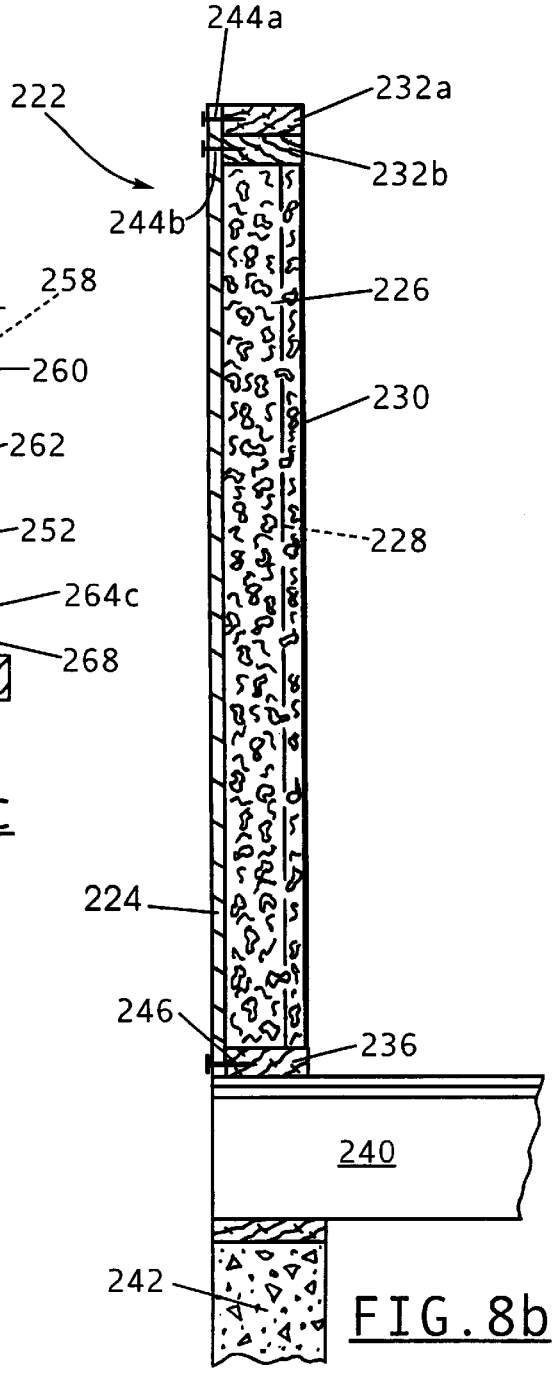

Referring to FIGS. 8*a* and 8*b,* there are respectively shown exploded and assembled sectional views of an arrangement for installing an asymmetric structural insulated panel 222 in a 2× structure in accordance with the present invention. The asymmetric structural insulated panel 222 includes a rigid outer facing 224, an inner plastic impregnated paper sheet 230, and an insulating core 226 disposed between and coupled to the rigid outer facing and plastic impregnated sheet. Structural insulated panel 222 further includes one or more vertically aligned internal nailers 228 (shown in dotted line form in the figures) each in the form of an elongated, linear strip disposed in the panel's insulating core 226. The panel's insulating core 226 may be comprised of plastic foam, wheat-, straw-, or agricultural board, or virtually any conventional structural insulating material. The rigid outer facing 224 may be comprised of oriented strand board, or a cement or gypsum composite. Structural insulated panel 222 is adapted for connection to a bottom plate 236 which is coupled to and supported by a floor 240 which, in turn, is coupled to and supported by a support wall 242. Structural insulated panel 222 is further adapted for connection to first and second top plates 232*a* and 232*b* as shown in FIG. 8*b*. The structural insulated panel 222 and the first and second top plates 232*a,* 232*b* are moved in the direction of arrows 234 and 238 to form the assembled structure shown in FIG. 8*b*. First and second couplers or fasteners such as nails, screws or staples 244*a* and 244*b* are inserted through an upper edge of the panel's rigid outer facing 224 and into the first and second top plates 232*a* and 232*b*. A third coupler 246 is inserted through a lower edge of the panel's rigid outer facing 224 and into the bottom plate 236.

There are various advantages in connecting the asymmetric structural insulated panel 222 to 2× structural support members. For example, it is much simpler to cut off the ends of the plastic impregnated paper sheet 230 and the insulating core 226 to match the size of the opening than in the case of prior art double-faced structural insulated panels. Matching the distance between the 2× structural members between which a double-faced structural insulated panel is to be connected requires grooving out the inner foam core of the panel disposed between its pair of outer facings. A 2× structural member is then positioned in the thus formed groove. Forming this groove is difficult and time consuming, particularly when using tools typically available in the field. It is easier and simpler to merely notch out the insulating core of an asymmetric insulated panel by cutting it from the open side of the panel in sizing the panel to accommodate a pair of spaced 2× structural members. In addition, attaching the single outer face of the asymmetric structural panel to the bottom and top plates as shown in FIG. 8*b* is easier and faster than attaching both outer facings of conventional dual-faced structural insulated panel to the 2× plates. Finally, an asymmetric structural insulated panel has the same thickness as common 2× stick construction and can be used in combination with the 2× stick construction in the same structure without modification such as the addition of jamb extensions around doors and windows formed in a wall.

Referring to FIG. 8*c,* there is shown another arrangement in accordance with the present invention incorporating an asymmetric structural insulated panel 250 in a common 2× stick construction structure. Structural insulated panel 250 includes an insulating core 252 and a rigid outer facing 254 disposed on and attached to one surface of the insulating core. Disposed on and attached to a second, opposed surface of the panel's insulating core 252 is a plastic impregnated sheet 262. Disposed in the panel's insulating core 252 is an electrical chase 260 as well as a plurality of spaced nailer strips, where one of the nailers is shown in dotted line form as element 256 in the figure. An edge of the panel's insulating core 252 is placed in abutting contact with a 2× lumber sill plate 268, with an adjacent edge of the panel's rigid outer facing 254 attached to the sill plate by means of a staple 272. Beads of mastic 264*a,* 264*b* and 264*c* are disposed between the lumber sill plate 268 and the edge of the panel's insulating core 252 to provide a high degree of adhesion and a good seal between these two structural components. A second 2× lumber sill plate 270 may be disposed in abutting contact with the lower surfaces of the panel's rigid outer facing 254 and the lumber sill plate 268. A bead of mastic 266 may be disposed between the two sill plates 268 and 270 for bonding these two structural members together. An inner gypsum drywall sheet 258 (shown in the figure in dotted line form) may be attached to the plastic impregnated paper sheet 262 of the structural insulated panel 250 by conventional means such as by an adhesive. In addition, the inner gypsum drywall sheet 258 may be attached to the lumber sill plate 268 by other conventional means such as staples, nails or screws (also not shown for simplicity).

Figure 9A:
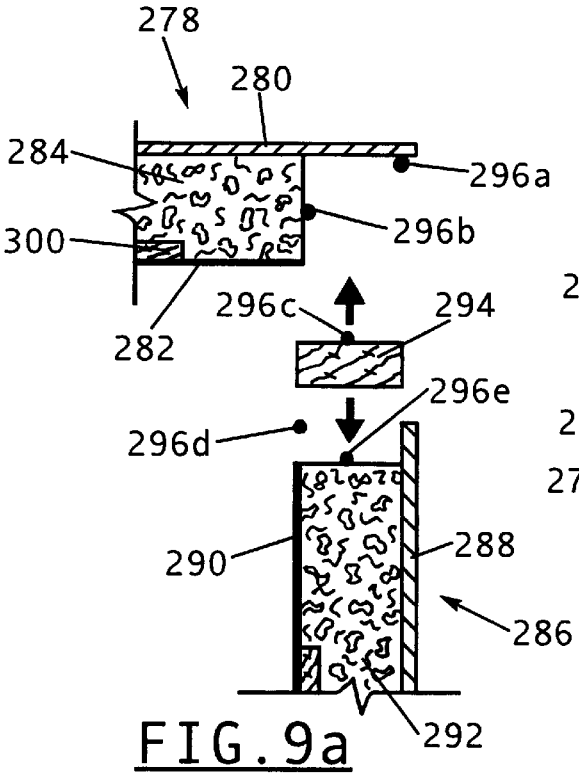
FIGS. 9*a* and 9*b* are respectively exploded and assembled views of another arrangement for incorporating an asymmetric structural panel in a 2× based structure in accordance with the present invention.
Figure 9B:
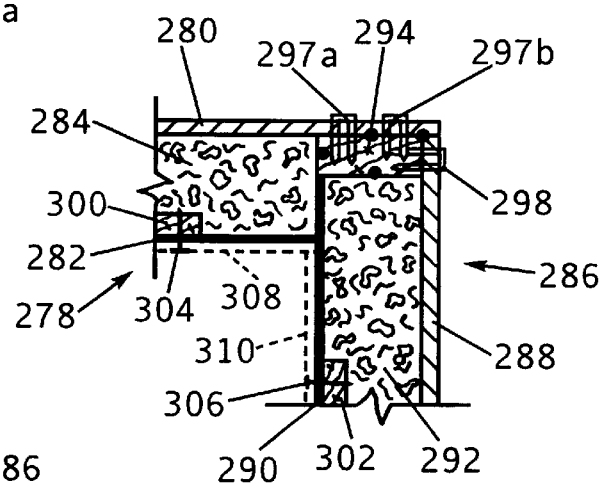

Referring to FIGS. 9*a* and 9*b,* there are respectively shown exploded and assembled sectional views of first and second asymmetric structural insulated panels 278 and 286 connected together in a structure of 2× construction. The first structural insulated panel 278 includes an inner insulating core 284, a rigid outer facing 280 disposed on a first surface of the insulating core, and a plastic impregnated paper sheet 282 disposed on and attached to a second opposed surface of the panel's insulating core. Disposed within the insulating core 284 and engaging the plastic impregnated paper sheet 282 is a nailer 300 typically comprised of wood. The rigid outer facing 280 is preferably comprised of an oriented strand board (OSB) composition or a cement or gypsum composite, while the insulating core 284 is preferably comprised of expanded polystyrene. The second structural insulated panel 286 is similarly comprised of an insulating core 292, a rigid outer facing 288 disposed on and attached to a first surface of the insulating core, and a plastic impregnated paper sheet 290 disposed on and attached to a second, opposed surface of the panel's insulating core. Respective ends of the insulating cores 284 and 292 have been notched out so that each of the rigid outer facings 280 and 288 extend beyond their associated insulating cores. The notched out portions of the insulating cores 284, 292 are adapted to receive a 2× lumber nailer 294. Various beads of mastic 296*a*–296*e* are deposited between the insulating cores, the outer facings, and the 2× lumber nailer 294 to securely join and form a seal between these structural members. First and second staples 297*a* and 297*b* connect the rigid outer facing 280 of the first structural insulated panel 278 to the 2× lumber nailer 294. A third staple 298 connects the rigid outer facing 288 of the second structural insulated panel 286 to the 2× lumber nailer 294. A first inner drywall sheet 308 (shown in dotted line form) is disposed on the inner surface of the first structural insulated panel 278 and engages its plastic impregnated sheet 282. The first inner drywall sheet 308 is attached to the first structural insulated panel 278 by means of a coupler, such as a nail, 304 inserted through the drywall sheet and into the panel's nailer strip 300. A second inner drywall sheet 310 (also shown in dotted line form) is attached to the inner surface of the second structural insulated panel 286 also by means of a coupler 306 inserted into the internal nailer strip 302 within the panel. It should be noted that in the corner coupling arrangement shown in FIGS. 9*a* and 9*b,* the width of the two structural insulated panels is equal to the width of the 2× lumber nailer 294 as particularly shown for the case of the second structural insulated panel 286.

Figure 10A:
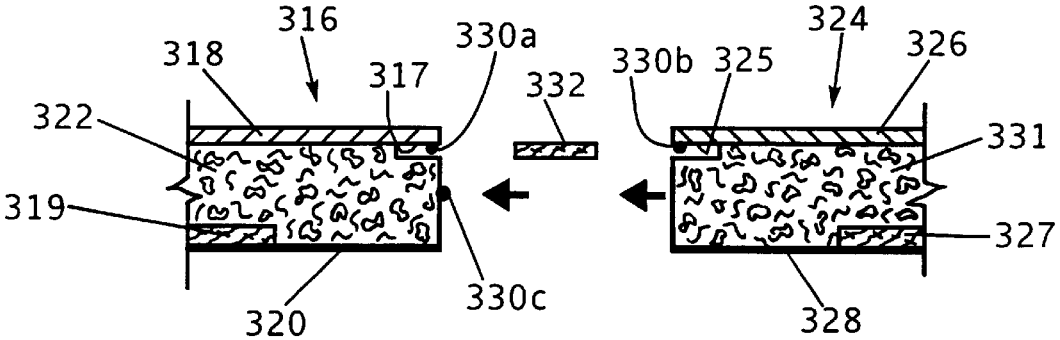
FIGS. 10*a* and 10*b* are respectively exploded and assembled sectional views of a pair of asymmetric structural insulated panels connected in accordance with another aspect of the present invention.
Figure 10B:
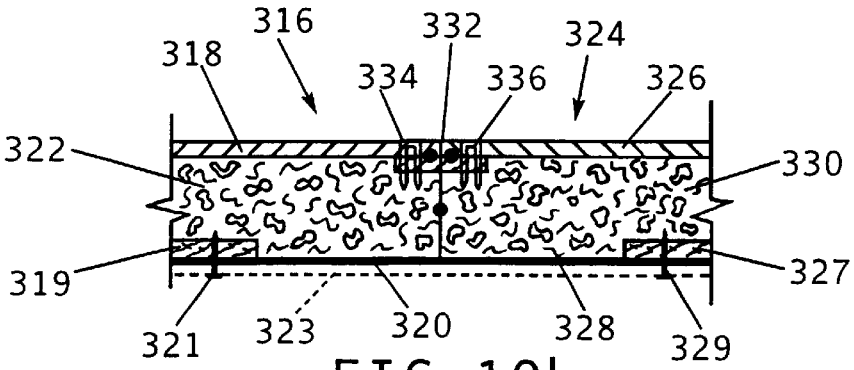

Referring to FIGS. 10*a* and 10*b,* there are respectively shown exploded and assembled sectional views of first and second asymmetric structural insulated panels 316 and 324 coupled in accordance with another aspect of the present invention. As in the previous embodiments, the first structural insulated panel 316 includes an insulating core 322, a rigid outer facing 318 disposed on and attached to a first surface of the insulating core, and a plastic impregnated paper sheet 320 disposed on and attached to a second, opposed surface, of the panel's insulating core. The insulating core includes a slot 317 in one end thereof. The insulating core 322 further includes a second slot within which is inserted an internal nailer strip 319. Similarly, the second structural insulated panel 324 includes an insulating core 331, a rigid outer facing 326 attached to and disposed on a first surface of the insulating core, and a plastic impregnated paper sheet 328 disposed on and attached to a second, opposed surface of the panel's insulating core. The insulating core 331 of the second panel is also provided with a first internal slot 325 and a second internal slot within which is inserted a nailer strip 327.

Several beads of mastic 330*a,* 330*b* and 330*c* are disposed in the joint between the assembled first and second structural insulated panels 316 and 324 as shown in the figures. Mastic bead 330*c* is preferably applied in a continuous, serpentine manner to one of the insulating cores and extends the entire length of the joined panels. In addition, a coupling spline 332 is inserted in the facing slots 317 and 325 of the first and second structural insulated panels 316, 324. A pair of staples 334 and 336 are respectively inserted through the rigid outer facings 318 and 326 of the first and second structural insulated panels and into the coupling spline 332 for securely joining the two panels. Coupling spline 332 as well as the nailer strips 319 and 327 are preferably comprised of wood.

An inner drywall sheet 323 (shown in FIG. 10*b* in dotted line form) is attached to the inner surfaces of the first and second structural insulated panels 316 and 324 by means of first and second couplers 321 and 329 inserted through the drywall sheet and into nailer strips 319 and 327, respectively.

Figure 11A:
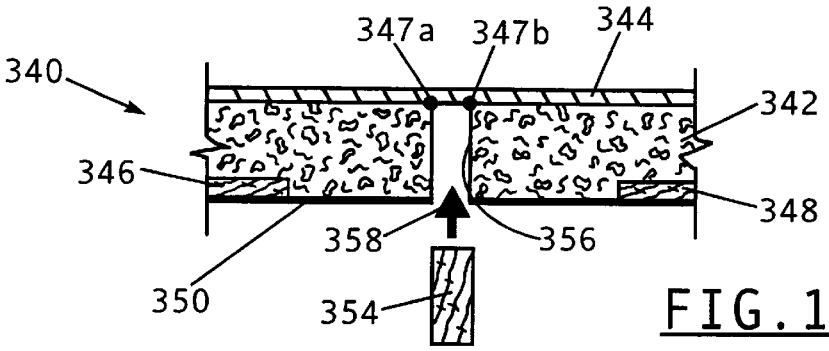
FIGS. 11*a* and 11*b* show yet another arrangement for installing and connecting an asymmetric structural insulated panel in a 2× based structure.
Figure 11B:
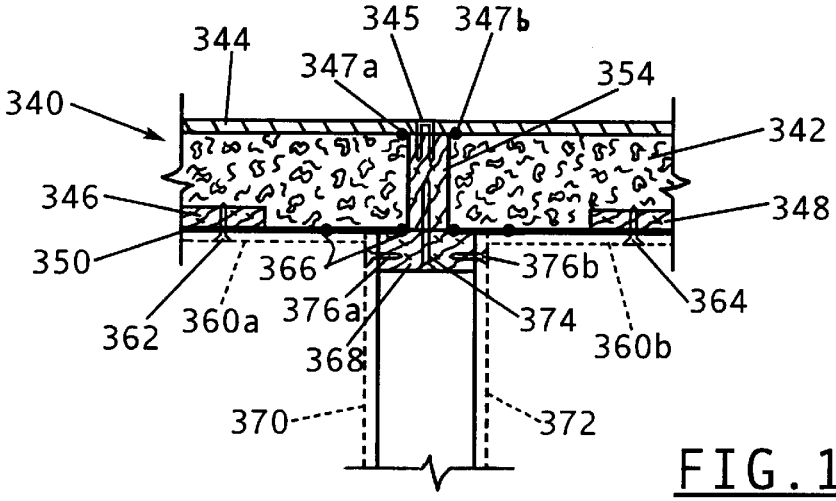

Referring to FIGS. 11*a* and 11*b*, there are respectively shown exploded and assembled sectional views of another arrangement for connecting a generally horizontal asymmetric structural insulated panel 340 to a vertical wall juncture. Structural insulated panel 340 includes an inner insulating core 342, a rigid outer facing 344 attached to a first upper surface of the insulating core, and a plastic impregnated paper sheet 350 attached to a second, opposed lower surface of the insulating core. Disposed within the panel's insulating core 342 are first and second nailers 346 and 348 which are also disposed in contact with the panel's inner plastic impregnated paper sheet 350. In connecting the structural insulated panel 340 to a wall juncture, a notch is cut through the plastic impregnated paper sheet 350 and into the insulating core 342 so as to form a slot 356 in the insulating core. A 2× insert member 354 is then inserted in slot 356 in the direction of arrow 358. The 2× insert member 354 is secured to the panel's rigid outer facing 344 by conventional means such as a staple 345. Beads of mastic 347*a* and 347*b* are deposited at the juncture of the rigid outer facing 344, the insert member 354, and the panel's insulating core 342. The beads of mastic increase the strength of the connection between the structural insulated panel and the 2× insert member 354.

A 2× wall header 368 is attached to the 2× insert member 354 by means of a coupler such as a nail or screw 374. The 2× wall header 368 extends across the 2× insert member 354 to the respective portions of the insulating core 354 on both sides of the insert member. First and second drywall sheets 370 and 372 (shown in the FIG. 11*b* in dotted line form) are attached to respective opposed surfaces of the 2× wall header 368 by means of couplers 376*a* and 376*b*. The first and second drywall sheets 370, 372 form opposed surfaces of a wall structure attached to the structural insulated panel 340 by means of the 2× insert member 354 and wall header 368. Third and fourth drywall sheets 360*a* and 360*b* (also shown in dotted line form) are attached to respective lower portions of the structural insulated panel 340 by means of couplers 362 and 364 inserted through the drywall sheets and into nailers 346 and 348, respectively. Beads of mastic 366 are disposed between the panel's plastic impregnated paper sheet 350 and the third and fourth drywall sheets 360*a*, 360*b* as well as between the 2× insert member 354 and 2× wall header 368. The panel connection arrangement shown in FIGS. 11*a* and 11*b* represents an easy, efficient way to form a juncture between a ceiling or roof panel and a wall using 2× structural components and an asymmetric structural insulated panel in accordance with another aspect of the present invention.

Figure 12:
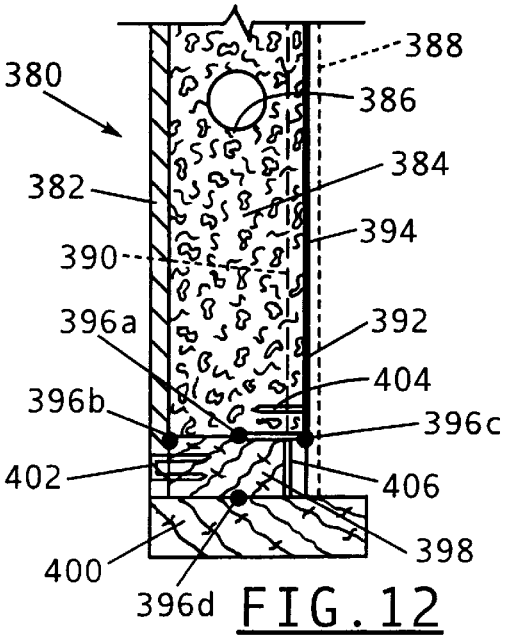
FIG. 12 is a sectional view showing another arrangement for connecting an asymmetric structural insulated panel to a 2× base member in accordance with the present invention.

Referring to FIG. 12, there is shown a sectional view of another arrangement for attaching an asymmetric structural insulated panel 380 to a 2× sill plate 398 in accordance with the present invention. As in the previous embodiments, the structural insulated panel 380 includes an insulating core 384, a rigid outer facing 382 attached to a first surface of the insulating core, and a plastic impregnated paper sheet 394 attached to a second, opposed surface of the panel's insulating core. Disposed within the panel's insulating core 384 is an electrical chase 386 as well as one or more internal nailers 390 shown in dotted line form in the figure. The structural insulated panel 380 is connected to the 2× sill plate 398 by means of a staple 402 inserted through an edge portion of the panel's rigid outer facing 382 and into the sill plate. Attached to the 2× sill plate 398 by means of a plurality of spaced couplers 406 is a generally L-shaped wind clip 392. Wind clip 392 is securely attached to the 2× sill plate 398 by means of a plurality of spaced couplers 406 inserted through the wind clip and into the sill plate. The wind clip 392 is also connected to the structural insulated panel 380 by means of a plurality of couplers 404 inserted through the wind clip and into the internal nailers 390 within the panel. Wind clip 392 extends along the entire length of the structural insulated panel 380 and is preferably comprised of a high strength material such as sheet metal. A second 2× sill plate 400 may be attached to the first 2× sill plate 398 by conventional means which are not shown in the figure for simplicity. Beads of mastic 396*a*–396*d* are inserted in the junctures between the structural insulated panel 380 and the first 2× sill plate 398 and in also between the two sill plates as shown in the figure. A thermal barrier in the form of a ½ inch drywall sheet 388 (shown in the figure in dotted line form) is attached to the inner surface of the structural insulated panel 380 by conventional means such as an adhesive or by couplers inserted through the drywall sheet and into the spaced internal nailers 390 within the panel.

Figure 13:
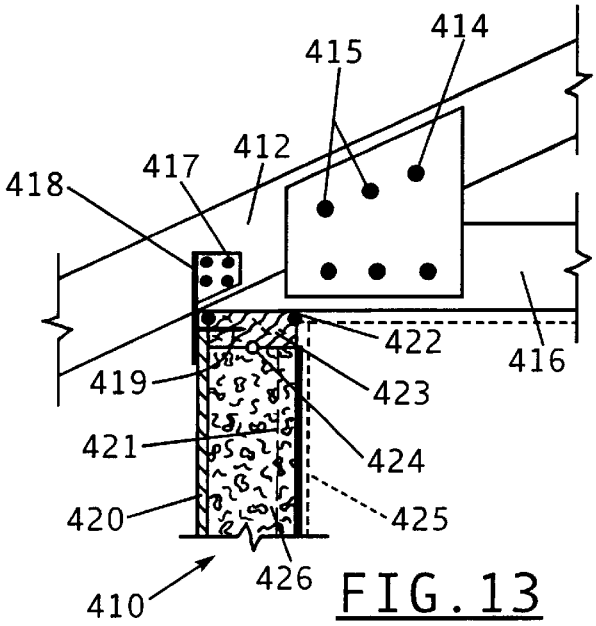
FIG. 13 is a sectional view showing the manner in which a wall is connected to a ceiling in accordance with another aspect of the present invention.

Referring to FIG. 13, there is shown a simplified sectional view of an arrangement for connecting an asymmetric structural insulated panel 410 to a roof beam 412 and ceiling joist 416 in accordance with another embodiment of the present invention. In FIG. 13, the roof beam 412 is connected to the ceiling joist 416 by means of a metal nailing plate 414 and nails 415 inserted through the metal nailing plate and into the roof beam and ceiling joist. A metal truss 418 is connected to the roof beam 412 by means of first nails 417 and is further connected to an upper wall plate 423 by means of second nails 419. Beads of mastic 422 are placed between the upper wall plate 423, which is a conventional 2× structural member, and the ceiling joist 416. A structural insulated panel 410 is placed in contact with and supported from the upper wall plate 423. Structural insulated panel 410 includes an inner insulating core 426, a rigid outer facing 420 attached to one surface of the insulating core and preferably comprised of oriented strand board or a cement or gypsum composite, and an insulating sheet 424 such as comprised of plastic foam or wheat-, straw-, or agricultural board attached to a second, opposed surface of the panel's insulating core. The structural insulated panel 410 is attached to the metal truss 418 as well as to the upper wall plate 423 by means of the aforementioned nails 419 inserted through an upper edge of the panel's rigid outer facing 420. A bead of mastic 424 is disposed between the upper wall plate 423 and the upper edge of the panel's insulating core 426. The bead of mastic 424 forms a seal between and bonds the panel's insulating core 426 to the upper wall plate 423. Because the panel's insulating core 426 and the upper wall plate 423 have the same thickness, an inner drywall sheet 425 (shown in the figure in dotted line form) may be attached to the inner surfaces of the insulating core and upper wall plate by conventional means such as an adhesive or nails or screws. The outer surface of the inner drywall sheet 425 is flush, or in intimate abutting contact, with the panel's plastic impregnated paper sheet 424 as well as with the upper wall plate 423. A second drywall sheet 427 also shown in dotted line form may be attached to and suspended from the ceiling joist 416 also by conventional means such as an adhesive or nails or screws.

There has thus been shown an asymmetric structural insulated panel for building construction which includes an insulating core, a rigid outer facing affixed to one surface of the insulating core, and a plastic impregnated paper sheet attached to a second, opposed surface of the panel's insulating core. The plastic impregnated paper provides a high tensile strength for the structural insulated panel to accommodate large transverse loads applied to the panel. The plastic impregnated paper sheet may also be bonded to a sheet of drywall to which the panel is attached rather than to the panel's insulating core to provide the panel with increased strength. The insulating core is comprised of a wheat-, straw-, or agricultural board or a plastic such as expanded polystyrene or urethane, while the rigid outer facing is comprised of oriented strand board, cement or gypsum composite, or plywood. Elongated nailers also comprised of OSB or wood are disposed in a spaced manner within the panel's insulating core and in contact with the plastic impregnated paper sheet to provide the paper coated surface of the panel with high compressive strength to withstand large axial or racking loads. The panels are compatible with 2× stick construction and are easily incorporated in this type of structure. An edge of the panel's insulating core is notched out to permit the panel's rigid outer facing to be attached to 2× structural members by conventional means such as nails, screws, staples or an adhesive. The panel's inner insulating core is of the same thickness as a 2× structural member. This permits an inner facing member such as of gypsum wallboard to be placed in contact with and adhered to the panel's plastic impregnated paper sheet and to be attached to the 2× structural member. This eliminates the need for window or door jamb extensions. Openings, such as for windows, can be incorporated in the asymmetric structural insulated panels in the field using a conventional device such as a circular saw.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

I claim:

1. For use in 2× stick construction, a structural panel coupling arrangement comprising:

a 2× structural member comprised of lumber and having a given thickness and a given width;

a first asymmetric structural insulated panel having an insulating core, a rigid outer facing attached to a first surface of said insulating core, and a high strength sheet of plastic impregnated paper attached to a second opposed surface of said insulating core, wherein said insulating core is comprised of a rigid insulating material and has a width equal to the width of said 2× structural member and includes a notched out edge portion forming an edge extension of said rigid outer facing having a thickness equal to the thickness of said 2× structural member;

at least one nailer member disposed within said insulating core, wherein said at least one nailer member increases the compressive strength of said panel and is adapted for attaching an inner panel to the second opposed surface of said insulating core; and means for attaching a first surface of said 2× structural member to the edge extension of said rigid outer facing and a second surface of said 2× structural member to the insulating core of said structural insulated panel, wherein the sheet of plastic impregnated paper on said panel is aligned with a third surface of said 2× structural member, and wherein said first and third surfaces are in opposed relation on said 2× structural member.

2. The arrangement of claim 1 further comprising an inner panel attached to said structural insulated panel and disposed in abutting contact with the panel's plastic impregnated paper sheet and the third surface of said 2× structural member.

3. The arrangement of claim 2 wherein said inner panel is coupled to said structural insulated panel by means of couplers inserted through said inner panel and into said at least one nailer member.

4. The arrangement of claim 3 wherein said couplers are nails, screws or staples.

5. The arrangement of claim 2 further comprising adhesive means for bonding said inner panel to said 2× structural member and to the plastic impregnated sheet of said structural insulated panel.

6. The arrangement of claim 2 wherein said insulating core is comprised of plastic foam, or wheat-, straw-, or agricultural board.

7. The arrangement of claim 2 wherein said rigid outer facing is comprised of oriented strand board, cement or gypsum composite.

8. The arrangement of claim 2 wherein said inner panel is comprised of gypsum drywall.

9. The arrangement of claim 3 further comprising a wind clip disposed between said insulating core and said 2× structural member and engaging the plastic impregnated paper sheet of said structural insulated panel.

10. The arrangement of claim 9 further comprising means for connecting said wind clip to said 2× structural member and to said at least one nailer member.

11. The arrangement of claim 1 further comprising a second asymmetric structural insulated panel having an insulating core, a rigid outer facing attached to a first surface of said insulating core, and a high strength sheet of plastic impregnated paper attached to a second opposed surface of said insulating core, wherein said insulating core includes a notched out edge portion forming an edge extension of said rigid outer facing, and wherein the notched out portion of said second structural insulated panel is attached to said 2× structural member and to the plastic impregnated paper sheet of said first panel, and wherein the edge extension of said second panel's outer facing is attached to said 2× structural member.

12. The arrangement of claim 11 wherein said first and second structural insulated panels form a generally 90° coupling arrangement.

13. For use in 2× stick building construction, a structural panel coupling arrangement comprising:

a 2× structural member comprised of lumber and having a given thickness and a given width;

an asymmetric structural insulated panel having a rigid insulating core, a rigid upper facing attached to an upper surface of said insulating core, and a high strength sheet of plastic impregnated paper attached to an opposed lower surface of said insulating core, wherein said plastic impregnated paper sheet and said insulating core includes a notched out portion for receiving said 2× structural member in tight fitting engagement and wherein said 2× structural member inserted in said notched out portion engages said rigid upper facing;

means for connecting said rigid upper facing to said 2× structural member;

at least one nailer member disposed within said insulating core wherein said at least one nailer member is adapted for attaching an inner panel to the lower surface of said insulating core: and a generally vertical wall including a 2× upper wall plate coupled to said 2× structural member disposed in said structural insulated panel.

14. A structural panel arrangement comprising:

first and second asymmetric structural insulated panels each having a rigid insulating core, a rigid upper facing attached to an upper surface of said insulating core, and a high strength sheet of plastic impregnated paper attached to an opposed lower surface of said insulating core;

first and second slots respectively disposed in the insulating cores of said first and second structural insulated panels immediately adjacent to the respective rigid upper facings of the panels;

a spline disposed in said first and second slots in a tight-fitting manner and attached to the rigid upper facings of said first and second structural insulated panels for connecting said panels;

first and second nailers respectively disposed in the insulating cores of said first and second structural insulated panels adjacent the plastic impregnated sheet of the panel;

an inner panel disposed in contact with the plastic impregnated sheets of said first and second structural insulated panels; and coupling means for connecting said inner panel to the first and second nailers in said first and second structural insulated panels.

* * * * *